United States Patent [19]

Becher et al.

[11] Patent Number: 4,564,513

[45] Date of Patent: Jan. 14, 1986

[54] PROCESS FOR THE PRODUCTION OF CARBON MONOXIDE

[75] Inventors: Dieter Becher, Brunsbuettel; Christian König, Kaarst; Eckhard Tiemann, Dormagen; Hans Czwalinna, Pulheim; Wilhelm Hagen, Leverkusen, all of Fed. Rep. of Germany

[73] Assignee: Bayer Aktiengesellschaft, Fed. Rep. of Germany

[21] Appl. No.: 665,724

[22] Filed: Oct. 29, 1984

[30] Foreign Application Priority Data

Nov. 11, 1983 [DE] Fed. Rep. of Germany ..... 3340929

[51] Int. Cl.[4] ..... C01B 1/04; C01B 31/18

[52] U.S. Cl. ..... 423/415 A

[58] Field of Search ..... 423/415 A

[56] References Cited

U.S. PATENT DOCUMENTS

| | | | |
|---|---|---|---|
| 3,325,253 | 6/1967 | Schmidt | 423/415 A |
| 3,635,672 | 1/1972 | Johnson | 423/415 A |
| 4,244,180 | 1/1981 | Rasor | 423/415 A |
| 4,436,530 | 3/1984 | Child et al. | 423/415 A |

FOREIGN PATENT DOCUMENTS

| | | | |
|---|---|---|---|
| 1950517 | 4/1971 | Fed. Rep. of Germany . | |
| 2001844 | 7/1971 | Fed. Rep. of Germany ... | 423/415 A |
| 2046172 | 4/1972 | Fed. Rep. of Germany . | |

*Primary Examiner*—John Doll
*Assistant Examiner*—Wayne A. Langel
*Attorney, Agent, or Firm*—Connolly and Hutz

[57] ABSTRACT

Carbon monoxide is produced in an improved process in a carbon-filled, water-cooled generator in the configuration of a truncated cone in the longitudinal section, by the gasification of said carbon with a mixed gas of oxygen and carbon dioxide, wherein the improvement comprises injecting the mixed gas into the generator through at least one downwardly-directed, coolable nozzle arranged in the generator sidewall and removing the carbon monoxide formed.

10 Claims, 1 Drawing Figure

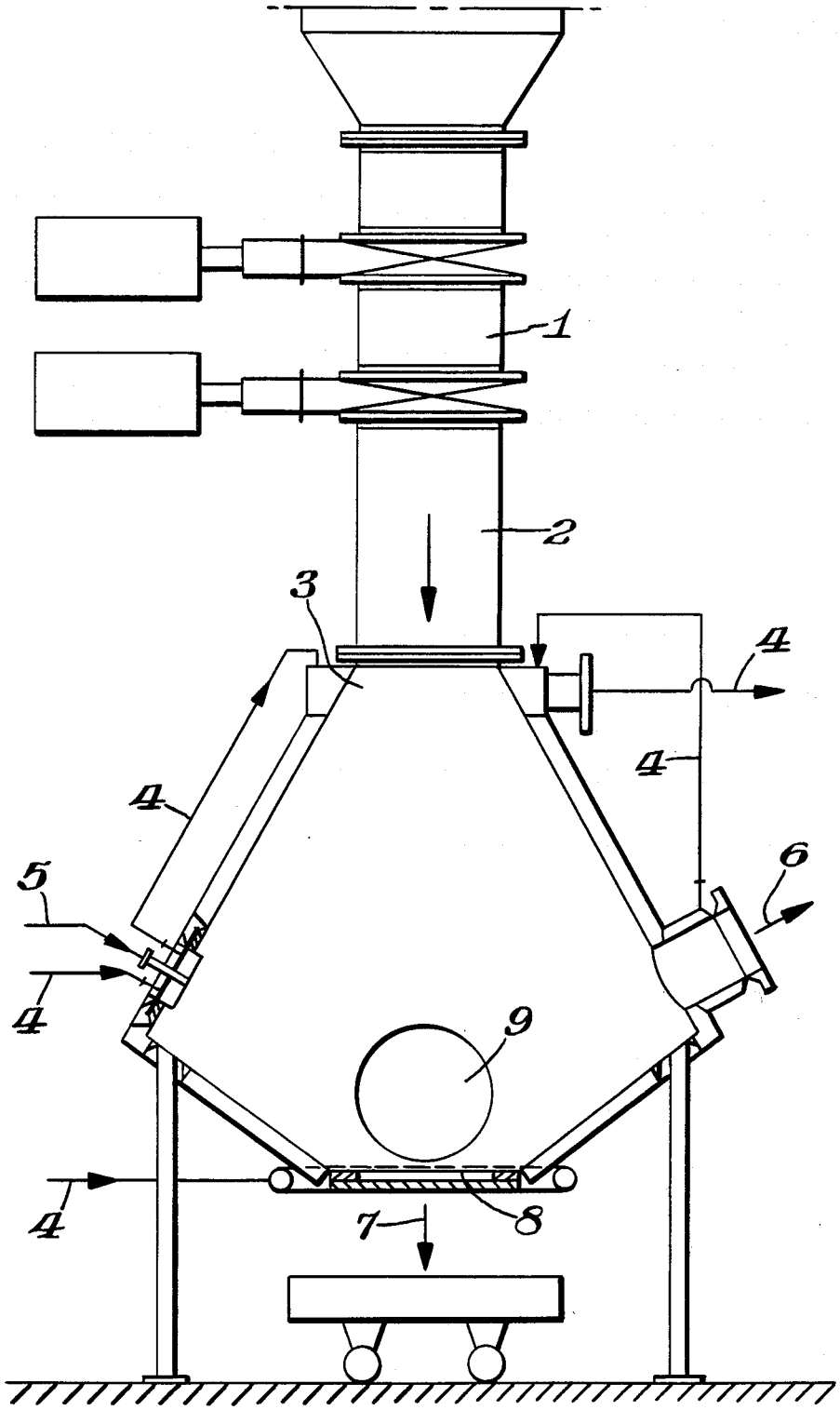
1
2
3
4
4
4
5
4
6
9
4
7
8

PROCESS FOR THE PRODUCTION OF CARBON MONOXIDE

BACKGROUND OF THE INVENTION

This invention relates to a process for the production of carbon monoxide in a water-cooled generator which has the form of a truncated cone in longitudinal section. The generator is filled with carbon and by gasification of carbon with a mixture of oxygen and carbon dioxide, carbon monoxide is produced.

The production of carbon monoxide from coal and oxygen has long been known and is practiced on a large industrial scale. In most cases truncated, cone-shaped generators are used having a volume of, for example, 4 $m^3$ which are fed with coke from above through a gate and subjected to oxygen through one or more water-cooled nozzles at the bottom of the generator. If coke is present in excess, most of the carbon monoxide is formed in a combustion zone, which is at a temperature above 1800° C., surrounding the stream of oxygen emerging from the nozzles at high velocity. The carbon monoxide is withdrawn at the top of the generator. The heat of reaction is in most cases removed by cooling water in the cooling jacket surrounding the generator. Steam generation is also possible, as described in DE-OS No. 1,950,517.

The process described above has the disadvantage, firstly, that the slag left from combustion of the coke accumulates at the bottom of the generator. This may considerably impair the efficiency of the nozzle(s) also located at the bottom. Damage by burning causes water to enter the generator and hydrogen appears in the production gas causing subsequent processing to be very difficult or even dangerous. In any case, continuous removal of slag is not possible.

Another disadvantage is that the volumetric output of a conventional generator is limited by heat generation as a result of the highly exothermic reaction of carbon with oxygen. Thus, for example, in a generator having a volume of 4 $m^3$ supplied with pure oxygen, the maximum carbon monoxide production achieved is 140 $m^3/h$, which correspnds to a volumetric output of 35 $m^3$ of $CO/h \times m^3$ of generator volume. An improvement in the heat transfer may be achieved by the introduction of a truncated cone-shaped hollow core which may be cooled, as described in DE-OS No. 2,046,172. Considerably more effective is the addition of carbon dioxide to the oxygen fed into the generator since the reaction between carbon dioxide and carbon is highly endothermic. The output of a generator of 4 $m^3$ capacity may in this way be increased to a volumetric output of 60 $m^3$ $CO/h \times m^3$ generator volume. The mixed gas used in this case may have an $O_2/CO_2$ ratio of 2:1. With this method, however, the output is still limited by the rate at which heat may be removed in the region of the nozzle.

SUMMARY OF THE INVENTION

It is therefore an object of the present invention to provide a process for the production of carbon monoxide which may be carried out more efficiently and does not have the above-described disadvantages of the known processes.

A process which fulfils all these requirements in a particularly advantageous manner has now surprisingly been found. The present invention departs from the method invariably employed in the past (i.e. arranging the nozzle(s) at the bottom of the generator) and, instead, introduces the nozzles laterally through the generator jacket and directed downwardly. By this change in the nozzle location, the above-described disadvantages may be overcome and a considerable increase in the volumetric output of the generator may be achieved with optimum utilization of the heat of reaction of carbon combustion.

The present invention therefore relates to a process for the production of carbon monoxide in a water-cooled generator which is in the form of a truncated cone in longitudinal section and is filled with carbon, and by gasification of the carbon with a mixed gas of oxygen and carbon dioxide, said mixed gas being injected into the generator through one or more downwardly directed, coolable nozzles provided on the generator jacket, while the carbon monoxide formed is removed in the opposite direction at the side and/or head of the generator. The coolable nozzles which extend through the generator jacket sidewall are spaced from the bottom of the generator and are downwardly-directed so that the gas stream from the nozzle is also directed downwardly. The nozzle spacing from the bottom of the generator should be sufficient to avoid contact with and interference from slag which forms and collects at the bottom of the generator. Otherwise the spacing from the bottom is not particularly critical.

The carbon used in this process is preferably coke. If additives, which depress the melting point of the slag are added to the coke, then liquid slag can be removed continuously or intermittently at the bottom of the generator.

The process can be carried out particularly effectively if the volumetric ratio of oxygen to carbon dioxide in the mixed gas is adjusted to a value of down 1:1, preferably somewhere in the range of from 1.2:1 to 1.3:1. This results in a significantly improved utilization of the heat of reaction of carbon combustion and a further increase in the volumetric output to over 400 $m^3$ $CO/h \times m^3$ of reaction volume.

Particularly complete conversion to carbon monoxide may be achieved by injecting oxygen through one or more additional nozzles situated above the downwardly-directed mixed gas nozzles.

It is found particularly advantageous for carrying out the process to equip the nozzles with a double-walled cooling jacket cooled with water. A further advantage is obtained by drawing off the product carbon monoxide gas laterally since this considerably reduces the thermal stress on the mechanical equipment for introducing coke at the head of the generator.

BRIEF DESCRIPTION OF THE DRAWING

A carbon monoxide generator for carrying out the process according to the present invention is illustrated schematically by the accompanying FIGURE. This is only one of many possible designs of such a carbon monoxide generator.

Through inlet (2), carbon is introduced into the generator chamber (3) from a gate (1). This generator chamber is surrounded by a cooling water system (4) and has a mixed gas ($O_2/CO_2$) nozzle (5) and an outlet (6) for the discharge of product gas. The slag (7) is removed through a slag outlet (8) at the bottom of the generator. An access hole (9) is provided for servicing the generator.

The process described may be applied analogously to other gas-solid reactions to similar advantage. Examples include the production of generator gas:

$$4N_2+O_2+2C \rightleftharpoons 4N_2+2CO+Q$$

or synthesis gas:

$$Q+H_2O+C \rightleftharpoons H_2+CO$$

The present invention will now be explained with reference to a non-limiting Example.

EXAMPLE

Crushed coke is introduced at the rate of 780 kg/h into a carbon monoxode generator as illustrated in the accompanying FIGURE having a volume of 4 $m^3$ through a gate at the head of the generator and about 13 kg/h of slag (with additive) are removed at the bottom. 438 $Nm^3/h$ of oxygen and 362 $Nm^3/h$ of carbon dioxide are injected through nozzles in the generator jacket and 1600 $Nm^3/h$ of 98% pure carbon monoxide are withdrawn as crude gas with fly ash through a nozzle on the opposite side of the generator to be conveyed to the downstream gas purification steps.

What is claimed is:

1. In a process for the production of carbon monoxide in a carbon-filled, water-cooled generator in the configuration of a truncated cone in the longitudinal section, by the gasification of said carbon with a mixed gas of oxygen and carbon dioxide, wherein the improvement comprises injecting the mixed gas into the generator through at least one downwardly-directed, coolable nozzle arranged in the generator sidewall and removing the carbon monoxide formed in a direction opposite to the nozzle orientation at the side or head of the generator.

2. The process according to claim 1 wherein the carbon is in the form of coke.

3. The process according to claim 2 wherein additives are mixed with the coke for reducing the melting point of slag formed in the generator.

4. The process according to claim 1 wherein the volumetric ratio of oxygen to carbon dioxide in the mixed gas is down to 1:1.

5. The process according to claim 4 wherein the ratio is in the range of 1.2:1 to 1.3:1.

6. The process according to claim 1 wherein oxygen is injected through an additional nozzle arranged above the mixed gas nozzle.

7. The process according to claim 1 wherein the nozzle is equipped with a double jacket supplied with water for cooling.

8. The process according to claim 7 wherein the nozzles are copper.

9. The process according to claim 1 wherein liquid slag is removed intermittently at the bottom of the generator.

10. The process according to claim 1 wherein liquid slag is removed continuously at the bottom of the generator.

* * * * *